US010907111B2

(12) United States Patent
Guiducci et al.

(10) Patent No.: US 10,907,111 B2
(45) Date of Patent: Feb. 2, 2021

(54) USE OF A HYDROCARBYL-SUBSTITUTED SALICYLIC ACID DETERGENT AS AN INHIBITOR OF LEAD CORROSION

(71) Applicant: Castrol Limited, Reading (GB)

(72) Inventors: Aldo Guiducci, Reading (GB); Gordon Lamb, Shanghia (CN); Kevin West, Reading (GB)

(73) Assignee: Castrol Limited, Reading (GB)

( * ) Notice: Subject to any disclaimer, the term of this patent is extended or adjusted under 35 U.S.C. 154(b) by 0 days.

(21) Appl. No.: 15/549,142

(22) PCT Filed: Dec. 17, 2015

(86) PCT No.: PCT/EP2015/080225

§ 371 (c)(1),
(2) Date: Aug. 4, 2017

(87) PCT Pub. No.: WO2016/124291

PCT Pub. Date: Aug. 11, 2016

(65) Prior Publication Data

US 2018/0010062 A1 Jan. 11, 2018

(30) Foreign Application Priority Data

Feb. 6, 2015 (GB) ..... 1501991.2

(51) Int. Cl.

| | |
|---|---|
| ***C10M 129/42*** | (2006.01) |
| ***C10M 141/08*** | (2006.01) |
| ***C10M 163/00*** | (2006.01) |
| ***C10M 129/02*** | (2006.01) |
| ***C10M 125/04*** | (2006.01) |
| ***C10M 129/04*** | (2006.01) |
| ***C10M 129/34*** | (2006.01) |
| *C10N 10/04* | (2006.01) |
| *C10N 30/06* | (2006.01) |
| *C10N 30/12* | (2006.01) |
| *C10N 40/25* | (2006.01) |

(52) U.S. Cl.

CPC ..... *C10M 129/42* (2013.01); *C10M 125/04* (2013.01); *C10M 129/02* (2013.01); *C10M 129/04* (2013.01); *C10M 129/34* (2013.01); *C10M 141/08* (2013.01); *C10M 163/00* (2013.01); *C10M 2203/102* (2013.01); *C10M 2203/1006* (2013.01); *C10M 2203/1025* (2013.01); *C10M 2207/028* (2013.01); *C10M 2207/144* (2013.01); *C10M 2207/262* (2013.01); *C10M 2207/28* (2013.01); *C10M 2207/285* (2013.01); *C10M 2207/288* (2013.01); *C10M 2207/289* (2013.01); *C10M 2207/30* (2013.01); *C10M 2215/08* (2013.01); *C10M 2219/046* (2013.01); *C10M 2219/087* (2013.01); *C10M 2223/045* (2013.01); *C10N 2010/04* (2013.01); *C10N 2030/06* (2013.01); *C10N 2030/12* (2013.01); *C10N 2040/25* (2013.01)

(58) Field of Classification Search

CPC ..... C10M 129/42; C10M 129/34; C10M 129/04; C10M 125/04; C10M 2207/28; C10M 2207/262; C10N 2230/12; C10N 2210/02; C10N 2240/10; C10N 2230/06

See application file for complete search history.

(56) References Cited

U.S. PATENT DOCUMENTS

| | | | | |
|---|---|---|---|---|
| 2,991,251 | A | 7/1961 | Rudel et al. | |
| 5,413,725 | A | 5/1995 | Lal | |
| 5,770,185 | A | 6/1998 | Wachter et al. | |
| 5,773,391 | A | 6/1998 | Lawate | |
| 6,340,658 | B1 | 1/2002 | Cannon | |
| 6,645,923 | B2 * | 11/2003 | Dunn | C10M 163/00 508/460 |
| 7,622,431 | B2 | 11/2009 | Muir | |
| 8,404,625 | B2 | 3/2013 | Barton et al. | |
| 9,080,120 | B2 * | 7/2015 | Adams | C10L 1/191 |
| 9,127,232 | B2 | 9/2015 | West | |
| 9,353,327 | B2 | 5/2016 | Li | |
| 2005/0198894 | A1 | 9/2005 | Migdal et al. | |
| 2006/0090393 | A1 | 5/2006 | Rowland et al. | |
| 2008/0176778 | A1 | 7/2008 | Seemeyer et al. | |
| 2009/0152502 | A1 | 6/2009 | Muller et al. | |
| 2010/0087319 | A1 | 4/2010 | Mainz et al. | |
| 2011/0237479 | A1 | 9/2011 | Kocsis et al. | |
| 2011/0245120 | A1 | 10/2011 | Bertram | |

(Continued)

FOREIGN PATENT DOCUMENTS

| | | | |
|---|---|---|---|
| CN | 102206535 | A | 10/2011 |
| CN | 102575184 | A | 7/2012 |

(Continued)

OTHER PUBLICATIONS

International Search Report and Written Opinion for International Application No. PCT/EP2015/080225, dated Mar. 3, 2016.

(Continued)

*Primary Examiner* — Cephia D Toomer

(74) *Attorney, Agent, or Firm* — McDonnell Boehnen Hulbert & Berghoff LLP

(57) ABSTRACT

This invention relates to the use of a metallic or non-metallic detergent which is a hydrocarbyl-substituted salicylic acid or a derivative thereof in a non-aqueous lubricant composition as an inhibitor of lead corrosion associated with ashless, organic ester, anti-wear additives and/or friction modifiers.

17 Claims, No Drawings

(56) References Cited

U.S. PATENT DOCUMENTS

| | | | |
|---|---|---|---|
| 2013/0072408 | A1 | 3/2013 | Adams et al. |
| 2013/0167431 | A1 | 7/2013 | West |
| 2016/0264907 | A1 | 9/2016 | Chen et al. |

FOREIGN PATENT DOCUMENTS

| | | | |
|---|---|---|---|
| CN | 103946353 | A | 7/2014 |
| EP | 0 168 110 | | 1/1986 |
| EP | 1533362 | | 5/2005 |
| EP | 2290038 | A2 | 3/2011 |
| GB | 635708 | | 4/1950 |
| JP | 2006124536 | | 5/2006 |
| WO | 93/21288 | | 10/1993 |
| WO | 99/21902 | | 5/1999 |
| WO | 2003/099890 | | 12/2003 |
| WO | 2006/099250 | | 9/2006 |
| WO | 2007/068799 | A2 | 6/2007 |
| WO | 2008/124191 | | 10/2008 |
| WO | 2011/161406 | | 12/2011 |
| WO | 2012/056191 | | 5/2012 |
| WO | 2013/004811 | A1 | 1/2013 |
| WO | 2013/171319 | A1 | 11/2013 |

OTHER PUBLICATIONS

Thiel et al., SAE International, Paper # 2001-1-1962, The Fuel Additive/Lubricant Interactions: Compatibility Assessments in Field Studies and Laboratory Tests, published May 7, 2001, Abstract.

* cited by examiner

USE OF A HYDROCARBYL-SUBSTITUTED SALICYLIC ACID DETERGENT AS AN INHIBITOR OF LEAD CORROSION

This application claims priority to International Patent Application No. PCT/EP2015/080225, filed Dec. 17, 2015, which claims priority to GB 1501991.2, filed Feb. 6, 2015.

This invention relates to the use of metallic or non-metallic detergents which are hydrocarbyl-substituted salicylic acids or derivatives thereof in non-aqueous lubricant compositions as inhibitors of lead corrosion associated with ashless, organic ester, anti-wear additives and/or friction modifiers.

It is known to use anti-wear additives and/or friction modifiers in lubricant compositions. It is also known to use anti-wear additives and/or friction modifiers in fuel compositions for internal combustion engines. It is further known to use metallic or non-metallic hydrocarbyl-substituted salicylic acids or derivatives thereof as detergents in lubricant compositions.

The ingress of fuel and fuel additives into the crankcase lubricant of an internal combustion engine is known, for example from paragraph 2 of the abstract of SAE paper 2001-01-1962 by C. Y. Thiel et al "The Fuel Additive/Lubricant Interactions: . . . ".

A range of materials are known to be useful as anti-wear additives and/or friction modifiers in lubricant compositions; for example, zinc dihydrocarbyl dithiophosphates (ZDDP) have been used as anti-wear additives in lubricant compositions for many years. A disadvantage of these additives is that, when used to lubricate internal combustion engines, they give rise to ash which contributes to particulate matter in exhaust emissions from the internal combustion engines. Thus, in order to reduce the amount of ash-forming additives used for lubricating internal combustion engines, and also to reduce the amount of zinc and/or phosphorus and/or sulphur in the exhaust emissions from internal combustion engines, a variety of ashless, organic ester, anti-wear additives and/or friction modifiers have been developed for use in non-aqueous lubricant compositions and fuel compositions.

A potential disadvantage of such ashless organic ester anti-wear additives and/or friction modifiers is that their use is sometimes associated with an increase in lead corrosion, which can reduce their usefulness, particularly with respect to engines having relatively high proportions of lead containing components.

Whilst various materials have been suggested as corrosion inhibitors (also known as anti-corrosive agents), none have been identified as specifically inhibiting lead corrosion associated with ashless, organic ester, anti-wear additives and/or friction modifiers. Additionally, many known corrosion inhibitors are relatively expensive, and their incorporation in non-aqueous lubricant compositions can significantly increase the price of such compositions. Still further, these materials may adversely affect one or more other properties of the lubricant compositions in which they are incorporated. In general therefore, it would be beneficial if such materials could be replaced by lower cost materials and/or materials that provide additional beneficial properties to the lubricant composition in which they are incorporated, such as anti-wear and/or friction reduction properties.

Detergents (also called detergent additives) are often added to lubricant compositions, and may help reduce high temperature deposit formation, for example, on pistons in internal combustion engines, including, for example, high temperature varnish and lacquer deposits, by helping to keep finely divided solids in suspension in the lubricant composition. However, detergents have not previously been shown to inhibit lead corrosion, for example, lead corrosion associated with ashless, organic ester, anti-wear additives and/or friction modifiers. In particular, there has been no suggestion whatsoever that hydrocarbyl-substituted salicylic acid detergents are particularly suitable for such uses.

International patent application publication WO2008/124191 relates to a lubricating composition comprising a major amount of a GTL lubricating base oil and a friction modifier consisting essentially of oil soluble fatty acid esters of a polyol. According to WO2008/124191, the friction modifier is one or more fatty acid esters of a polyol, and it is stated that suitable polyols include diols, triols and the like, such as ethylene glycol, propylene glycol, glycerol and sorbitol. It is also stated that the esters of these polyols are those of carboxylic acids containing 12 to 24 carbon atoms, and that examples of such carboxylic acids include octadecanoic acid, dodecanoic acid, stearic acid, lauric acid and oleic acid. WO2008/124191 makes no reference to lead corrosion associated with the use of ashless, organic ester, anti-wear additives and/or friction modifiers, and does not suggest the use of hydrocarbyl-substituted salicylic acid detergents to inhibit such corrosion.

International patent application publication WO2011/161406 relates to the use of an oil-soluble mono-, di-, or tri-glyceride of at least one hydroxy polycarboxylic acid, or a derivative thereof, as an anti-wear additive and/or friction modifier in a non-aqueous lubricant composition and/or in a fuel composition. According to WO2011/161406, lubricant compositions comprising the oil-soluble mono-, di-, or tri-glyceride of at least one hydroxy polycarboxylic acid, or a derivative thereof, may be used to lubricate internal combustion engines. It is stated that in one embodiment, the hydroxy polycarboxylic acid has at least one hydroxy group which is in an alpha position with respect to a carboxylic moiety. Particularly desirable results are said to have been obtained with additives in which the glyceride is a glyceride of citric acid and oleic acid, a glyceride of citric acid and linoleic acid, or a mixture thereof. WO 2011/161406 makes no reference to lead corrosion associated with the use of ashless, organic ester, anti-wear additives and/or friction modifiers, and does not suggest the use of hydrocarbyl-substituted salicylic acid detergents to inhibit such corrosion.

International patent application publication WO 2012/056191 relates to the use as an anti-wear additive and/or friction modifier in a non-aqueous lubricant composition and/or in a fuel composition of at least one long chain fatty acid ester of a hydroxy carboxylic acid in which the long chain fatty acid has at least 4 carbon atoms and the ester is an oil-soluble ester of a mono- or poly-hydroxy carboxylic acid containing 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid. According to WO 2012/056191, lubricant compositions comprising the specified long chain fatty acid esters of hydroxyl carboxylic acids may be used to lubricate internal combustion engines. WO 2012056191 makes no reference to lead corrosion associated with the use of ashless, organic ester, anti-wear additives and/or friction modifiers, and does not suggest the use of hydrocarbyl-substituted salicylic acid detergents to inhibit such corrosion.

There remains a need for alternative materials that may be used as inhibitors of lead corrosion associated with ashless, organic ester, anti-wear additives and/or friction modifiers in non-aqueous lubricant compositions, including materials that have additional properties, for example being effective detergents, in such compositions.

Thus, according to the present invention there is provided the use of a metallic or non-metallic detergent which is a hydrocarbyl-substituted salicylic acid or a derivative thereof in a non-aqueous lubricant composition as an inhibitor of lead corrosion associated with ashless, organic ester, anti-wear additives and/or friction modifiers.

Also according to another aspect of the present invention there is provided a method of improving the anti-corrosion properties, for example inhibiting lead corrosion associated with ashless, organic ester, anti-wear additives and/or friction modifiers, of an oil of lubricating viscosity, which method comprises admixing said oil with an effective amount of at least one additive which is a metallic or non-metallic detergent which is hydrocarbyl-substituted salicylic acid or a derivative thereof.

The present invention solves the technical problem defined above by the use of a metallic or non-metallic detergent which is a hydrocarbyl-substituted salicylic acid or a derivative thereof in a non-aqueous lubricant composition as an inhibitor of lead corrosion associated with ashless, organic ester, anti-wear additives and/or friction modifiers.

Uses of the non-aqueous lubricant compositions incorporating metallic or non-metallic detergents which are hydrocarbyl-substituted salicylic acids or derivatives thereof as inhibitors of lead corrosion associated with ashless, organic ester, anti-wear additives and/or friction modifiers include all conventional lubricant purposes; for example, to lubricate an internal combustion engine. In at least some examples, the use of hydrocarbyl-substituted salicylic acid detergents as inhibitors of lead corrosion in non-aqueous lubricant compositions permits the compositions to be used to provide effective lubrication and reduced lead corrosion, for example when the non-aqueous lubricant composition also comprises one or more ashless, organic ester, anti-wear additives and/or friction modifiers, for example, at concentrations of greater than 0.1 wt %, greater than 0.2 wt %, greater than 0.5 wt %, greater than 0.75 wt % or greater than 1.0 wt %.

In at least some examples, the numerical percentages referenced in this application may be preceded by the word "about."

In at least some examples, the use of hydrocarbyl-substituted salicylic acid detergents as inhibitors of lead corrosion in non-aqueous lubricant compositions permits the compositions to be used to provide effective lubrication and reduced lead corrosion to an internal combustion engine when the liquid fuel composition used to operate the internal combustion engine comprises an ashless, organic ester, anti-wear additive and/or friction modifier, and a portion of the said ashless, organic ester, anti-wear additive and/or friction modifier ingresses into the non-aqueous lubricant composition during operation of said engine, irrespective of whether the lubricant composition also comprises an ashless, organic ester, anti-wear additive and/or friction modifier.

In at least some examples, the use of hydrocarbyl-substituted salicylic acid detergents in non-aqueous lubricant compositions as inhibitors of lead corrosion associated with ashless, organic ester, anti-wear additives and/or friction modifiers permits the compositions to be used to provide effective lubrication to internal combustion engines having high proportions of lead containing components, particularly if the lubricant compositions and/or the liquid fuel compositions used to operate the internal combustion engines comprise one or more ashless, organic ester, anti-wear additives and/or friction modifiers, for example at concentrations of greater than 0.1 wt %, greater than 0.2 wt %, greater than 0.5 wt %, greater than 0.7 wt % or greater than 1.0 wt %.

The use of metallic or non-metallic detergents which are hydrocarbyl-substituted salicylic acids or derivatives thereof in non-aqueous lubricant compositions as inhibitors of lead corrosion associated with ashless, organic ester, anti-wear additives and/or friction modifiers effectively reduces the lead corrosion in engines lubricated with said compositions when said compositions and/or the liquid fuel compositions used to operate said engines comprise one or more ashless, organic ester, anti-wear additives and/or friction modifiers, for example at levels associated with significant lead corrosion, for example when compared to compositions that are otherwise the same other than for the absence of a metallic or non-metallic detergent which is a hydrocarbyl-substituted salicylic acid or a derivative thereof.

Methods for measuring lead corrosion include standard methods, for example using a high temperature corrosion bench test (HTCBT) or an engine test such as the Sequence VIII test. In at least some examples, the use of a metallic or non-metallic detergent which is a hydrocarbyl-substituted salicylic acid or a derivative thereof in a non-aqueous lubricant composition comprising such an amount of an ashless, organic ester, anti-wear additive and/or friction modifier such that it would normally fail a HTCBT and/or Sequence VIII test will permit the non-aqueous lubricant composition to pass such a test.

The amount of metallic or non-metallic detergent which is a hydrocarbyl-substituted salicylic acid or a derivative thereof used in a non-aqueous lubricant composition as an inhibitor of lead corrosion associated with ashless, organic ester, anti-wear additives and/or friction modifiers includes any amount suitable to act as an inhibitor of lead corrosion, for example a concentration at which it provides both effective inhibition of lead corrosion associated with ashless, organic ester, anti-wear additives and/or friction modifiers, and effective detergent properties, for example from 0.5 to 15 wt %, 1 to 10 wt % or 2.5 to 8 wt %, for example 5 wt % or 6 wt %.

Any metallic or non-metallic hydrocarbyl-substituted salicylic acid or a derivative thereof which is a detergent may be used as an inhibitor of lead corrosion associated with ashless, organic ester, anti-wear additives and/or friction modifiers in accordance with the present invention. In at least some examples, the metallic or non-metallic hydrocarbyl-substituted salicylic acid or a derivative thereof is a substituted salicylic acid or a derivative thereof wherein the substituent is a linear or branched, saturated or unsaturated $C_5$ to $C_{30}$ alkyl chain. Optionally, the alkyl chain may be linked to the benzene ring of the salicylic acid by a heteroatom or a functional group. The alkyl chain may be, for example, a $C_{10}$ to $C_{30}$ alkyl chain, such as a $C_{10}$ to $C_{25}$ saturated alkyl chain or a $C_{16}$ to $C_{18}$ saturated alkyl chain. In at least some examples, the hydrocarbyl-substituted salicylic acid or a derivative thereof is a metallic hydrocarbyl-substituted salicylic acid or derivative thereof. Metallic hydrocarbyl-substituted salicylic acids or derivatives thereof may be overbased, in which the detergent comprises an excess of metal in relation to the stoichiometric amount required to neutralise the salicylic acid. The excess metal is usually in the form of a colloidal dispersion of metal carbonate and/or hydroxide. Examples of suitable metals include Group I and Group II metals, for example calcium, magnesium, sodium and combinations thereof. In at least some examples, more than one metal is present. In at least some examples, the metallic or non-metallic detergent is a sulphurised derivative of a hydrocarbyl-substituted salicylic acid.

In at least some examples, the metallic or non-metallic detergent which is a hydrocarbyl-substituted salicylic acid or derivative thereof is an inhibitor of lead corrosion associated with an ashless, organic ester, anti-wear additive and/or friction modifier which is:

i) at least one fatty acid ester of a polyol, ii) at least one oil-soluble mono, di-, or tri-glyceride of at least one hydroxy polycarboxylic acid, or a derivative thereof;

iii) at least one long chain fatty acid ester of a hydroxy carboxylic acid in which the long chain fatty acid has at least 4 carbon atoms and the ester is an oil-soluble ester of a mono- or poly-hydroxy carboxylic acid containing 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid; or iv) a mixture thereof.

Fatty Acid Esters of Polyols

Where the ashless, organic ester, anti-wear additive and/or friction modifier associated with lead corrosion is at least one fatty acid ester of a polyol, suitable polyols include diols, triols and the like, such as ethylene glycol, propylene glycol, glycerol and sorbitol. Examples of the esters of these polyols are those of carboxylic acids containing 12 to 24 carbon atoms. Examples of such carboxylic acids include octadecanoic acid, dodecanoate acid, stearic acid, lauric acid and oleic acid. In at least some examples, the fatty acid ester is a glycerol ester, for example a glycerol mono-ester, including for example glycerol mono-oleate, glycerol monostearate, glycerol monolaurate, glycerol dodecanoate and glycerol octadodecanoate.

Oil-Soluble Glycerides of at Least One Hydroxy Polycarboxylic Acid, or Derivatives Thereof Where the ashless, organic ester, anti-wear additive and/or friction modifier associated with lead corrosion is at least one oil-soluble mono, di-, or tri-glyceride of at least one hydroxy polycarboxylic acid, or a derivative thereof, in at least some examples, the hydroxy polycarboxylic acid has at least one hydroxy group or derivative (for example ether or ester) thereof, which is in an alpha position with respect to a carboxylic moiety.

In at least some examples, each hydroxy polycarboxylic acid independently has from 4 to 22 carbon atoms, for example 4 to 15 carbon atoms. In at least some examples, the oil-soluble mono-, di-, or tri-glyceride of at least one hydroxy polycarboxylic acid or derivative thereof has from 16 to 80 carbon atoms. The number of carbon atoms in the glyceride may affect its solubility in oil of lubricating viscosity.

By oil-soluble is meant that the glyceride is soluble in an oil of lubricating viscosity for example in a pour point depressant and friction modifying and/or anti-wear improving amount, for example in an amount by weight of at least 200 ppm in an oil of lubricating viscosity. In at least some examples, the solubility is determined at ambient temperature, for example at 20° C. Methods of determining the solubility include those for determining solubility at atmospheric pressure.

Suitable hydroxy polycarboxylic acids include:

citric acid (also sometimes called 3-carboxy-3-hydroxy pentanedioic acid; 2-hydroxypropane-1,2,3-tricarboxylic acid; or 3-hydroxypentanedioic acid-3-carboxylic acid);

tartaric acid (also sometimes called 2,3-dihydroxybutanedioic acid; or 2,3-dihydroxysuccinic acid);

malic acid (also sometimes called hydroxybutanedioic acid);

monohydroxy trimesic acid; and hydrogenated monohydroxy trimesic acid (sometimes also called 1,3,5 tricarboxy, 2-hydroxy cyclohexane).

Examples of the oil-soluble mono-, di-, or tri-glyceride of at least one hydroxy polycarboxylic acid, or a derivative thereof include a di-, or tri-glyceride which is a glyceride of at least one hydroxy polycarboxylic acid and at least one second carboxylic acid which is a saturated, mono-unsaturated or poly-unsaturated, branched or linear, monocarboxylic or polycarboxylic acid containing 4 to 22 carbon atoms, or a derivative thereof.

In at least some examples, the second carboxylic acid is saturated, mono-unsaturated or poly-unsaturated. In at least some examples, the second carboxylic acid is unsaturated. In at least some examples, the second carboxylic acid is branched or linear. In at least some examples, the second carboxylic acid is a monocarboxylic or polycarboxylic acid. If the second carboxylic acid is a polycarboxylic acid, the derivative of the glyceride includes those in which the glyceride is an ester of the second carboxylic acid group.

Suitable saturated second carboxylic acids include caproic acid, caprylic acid, capric acid, lauric acid, myristic acid, palmitic acid, stearic acid and arachidic acid. Suitable unsaturated second carboxylic acids include oleic acid, linoleic acid, linolenic acid, myristoleic acid, palmitoleic acid, sapienic acid, erucic acid (also known as cis-13-docosenoic acid) and brassidic acid.

In at least some examples, the glyceride is a glyceride of citric acid and oleic acid, a glyceride of citric acid and linoleic acid or a mixture thereof.

In at least some examples, the mono-, di-, or tri-glyceride of at least one hydroxy polycarboxylic acid or derivative thereof is represented by the general formula (I):

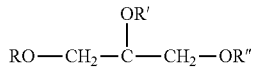

(I)

wherein RO, OR' and OR" independently represent:

—OH;

a saturated, mono-unsaturated or poly-unsaturated, branched or linear, monocarboxylic or polycarboxylic group containing from 4 to 22 carbon atoms or an ether or an ester thereof; or a hydroxy polycarboxylic acid moiety or an ether and/or ester thereof provided that at least one of RO, OR' and OR" is a hydroxy polycarboxylic acid moiety or an ether and/or ester thereof.

In at least some examples, in formula (I) at least one of RO, OR' and OR" is a hydroxy polycarboxylic acid moiety or an ether and/or ester thereof and at least one of RO, OR' and OR" is a saturated, mono-unsaturated or poly-unsaturated, branched or linear, monocarboxylic or polycarboxylic group containing from 4 to 22 carbon atoms or an ester thereof.

In at least some examples, in formula (I) the hydroxy polycarboxylic moiety acid has at least one hydroxy group or derivative (for example ether or ester) thereof which is in an alpha position with respect to a carboxylic moiety.

In at least some examples, in formula (I) each hydroxy polycarboxylic moiety independently has from 4 to 22 carbon atoms. In formula (I) the hydroxy polycarboxylic moiety, in at least some examples, is derivable from acids including, for example, citric acid, tartaric acid, malic acid, monohydroxy trimesic acid and hydrogenated monohydroxy trimesic acid.

In formula (I), when present, each saturated, branched or linear, monocarboxylic or polycarboxylic group containing from 4 to 22 carbon atoms or an ester thereof, in at least some examples, is derivable from saturated carboxylic acids or their halide equivalents. Suitable saturated carboxylic acids include, for example, caproic acid, caprylic acid, capric acid, lauric acid, myristic acid, palmitic acid, stearic acid and arachidic acid. In formula (I) when present, each mono-unsaturated or poly-unsaturated, branched or linear, monocarboxylic or polycarboxylic group containing from 4 to 22 carbon atoms or an ester thereof may be derivable from unsaturated carboxylic acids or their halide equivalents. Suitable mono-unsaturated acids include for example, oleic acid, myristoleic acid, palmitoleic acid, sapienic acid, erucic acid and brassidic acid. Suitable polyunsaturated acids include for example, linoleic acid and linolenic acid.

In at least some examples, the glyceride is a glyceride of at least one hydroxy polycarboxylic acid and a saturated $C_4$ to $C_{22}$ polycarboxylic acid, or a derivative thereof. Suitable polycarboxylic acids include branched and linear acids. In at least some examples, the glyceride is a glyceride of at least one hydroxy polycarboxylic acid and a mono-unsaturated or polyunsaturated $C_4$ to $C_{22}$ polycarboxylic acid, or a derivative thereof. Suitable polycarboxylic acids include branched and linear acids. In at least some examples glyceride is a glyceride of at least one hydroxy polycarboxylic acid and a saturated $C_4$ to $C_{22}$ monocarboxylic acid, or a derivative thereof. Suitable monocarboxylic acids include branched and linear acids. Suitable saturated $C_{16}$ monocarboxylic acids include palmitic acid. Suitable saturated $C_{18}$ monocarboxylic acids include stearic acid. In at least some examples, the glyceride is a glyceride of at least one hydroxy polycarboxylic acid and a mono-unsaturated or polyunsaturated $C_4$ to $C_{22}$ monocarboxylic acid, or a derivative thereof. Suitable unsaturated monocarboxylic acids include branched and linear acid. In at least some examples, the glyceride is a glyceride of at least one hydroxy polycarboxylic acid and an unsaturated $C_{18}$ monocarboxylic acid, or a derivative thereof. Suitable monocarboxylic acid include branched and linear acids. Suitable hydroxy polycarboxylic acids include citric acid. The glyceride additive may be a glyceride of citric acid and an unsaturated $C_{18}$ monocarboxylic acid, or a derivative thereof. Suitable unsaturated $C_{18}$ monocarboxylic acids include oleic acid and linoleic acid.

In at least some examples, the glyceride is a citric acid ester of a mono-glyceride of a saturated, mono-unsaturated or polyunsaturated, branched or linear, monocarboxylic or polycarboxylic $C_4$ to $C_{22}$ carboxylic acid, for example, a $C_{16}$ or $C_{18}$ carboxylic acid, for example palmitic acid, stearic acid, oleic acid or linoleic acid. Suitable glycerides include citric acid ester of mono-glyceride made from vegetable oil, for example sunflower and/or palm oil. Suitable glycerides include citric acid ester of mono-glyceride made from edible, refined sunflower and palm based oil. Suitably, the glyceride is a glyceride of citric acid and oleic acid, a glyceride of citric acid and linoleic acid or a mixture thereof. A suitable source of glycerides of citric acid with oleic acid and/or linoleic acid is GRINSTED CITREM SP70 (Trade Mark) which is available from Danisco. GRINSTED CITREM SP70 is believed to be a citric acid ester of mono-glyceride made from edible, refined sunflower and palm based oil. GRINSTED CITREM SP70 is also believed to comprise at least one diglyceride having the structural formula (II):

(II)

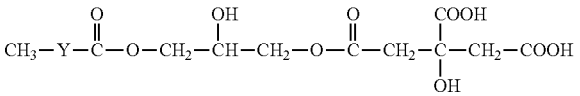

wherein —Y— represents a $C_{16}$ hydrocarbyl moiety which is mono- or di-unsaturated.

Thus, diglycerides having structural formula (II) include a glyceride of citric acid and oleic acid and a glyceride of citric acid and linoleic acid. This corresponds to a structure of formula (I) in which (i) RO represents a carboxyl group containing 18 carbon atoms, which may be derivable from oleic acid and/or linoleic acid, (ii) OR' represents a hydroxyl moiety, and (iii) OR" represents a hydroxy polycarboxylic acid moiety, which may be derivable from citric acid.

GRINSTED® CITREM N 12 VEG from Danisco is believed to be a neutralised citric acid ester of mono-glyceride made from edible, fully hydrogenated palm based oil. It was found to be unsuitable because it was not oil soluble.

The use of GRINSTED® CITREM 2-IN-1 from Danisco as a carboxylic acid anionic surfactant is described in paragraphs [0167] to [0171] of US patent application publication US 2008/0176778. US 2008/0176778 relates to conveyor lubricants including emulsion of a lipophilic compound and an emulsifier and/or an anionic surfactant (title). The lipophilic compound is said to include water insoluble organic compounds including two or more ester linkages and in one embodiment is said to be a water insoluble organic compound including three or more oxygen atoms. It is stated that in one embodiment, the lipophilic compound is an ester including a di-, tri-, or poly-hydric alcohol, such as glycerol, with 2 or more of the hydroxyl groups each being coupled to a carboxylic acid as an ester group (paragraph [0033]). In the example at paragraphs [0167] to [0171] two triglyceride lubricant compositions were tested. Lubricant A was said to contain an emulsion of 10 wt % of a caprylate, caprate, cocoate triglyceride in water to which was added the anionic surfactant 1.5 wt % lecithin (sold under the trade name Terradrill V408, Cognis) and the emulsifier 1.5 wt % 20 mol ethoxysorbitan monostearate (sold under the trade name Tween 60V, ICI). Lubricant B was said to contain 1.5 wt % citrate ester, said to be a carboxylic acid anionic surfactant sold under the name GRINSTED® CITREM 2-IN-1, Danisco in place of the Terradrill V408. According to paragraph [0171], Triglyceride lubricants including anionic surfactant worked well as dry conveyor lubricants and effectively lubricated after water was applied to the conveyor. According to paragraph [0061] of US 2008/0176778, the composition therein can include any variety of anionic surfactants that are effective to increase the ability of the lipophilic emulsion to withstand application of water to the conveyor. Examples are given in paragraphs [0065] to [0075] of ten classes of anionic surfactant.

According to paragraph [0029] of US patent application publication US 2009/0152502, hydrophilic emulsifier CITREM is a composition of matter containing citric esters of mono- and diglycerides of edible fatty acids. It is also stated therein that edible fatty acids have, in particular, 6 to 24 carbon atoms.

The glyceride may be an ester of citric acid with a partial glyceride, for example mono- or di-glyceride or mixtures thereof, which have free hydroxyl groups. Suitable partial glycerides include those derived from fatty acids with 12 to 18 carbon atoms, including, for example, those derived from coconut oil fatty acids and palm oil fatty acids. Examples include Lamegin® ZE 306, Lamegin® ZE 609 and Lamegin® ZE 618 (Cognis Deutschland GmbH & Co. KG). Thus suitable glycerides include a citric acid ester of the monoglyceride of hydrogenated tallow fatty acid, for example Lamegin® ZE 309, or an ester of diacetyl tartaric acid with monoglyceride of hydrogenated tallow fatty acid, for example Lamegin® DW 8000, or citric acid ester based on sunflower oil fatty acid monoglyceride, for example Lamegin® ZE 609 FL. Such esters are described, for example, in U.S. Pat. No. 5,770,185 and US 2010/0087319.

In at least some examples, the derivative of the glyceride is an ester of the at least one hydroxy polycarboxylic acid moiety. Suitable esters include esters of a carboxylic acid moiety of the hydroxy polycarboxylic acid. In at least some examples, each carboxylic acid moiety of the hydroxyl polycarboxylic acid is independently derivatisable as an ester. Suitable ester derivatives include hydrocarbyl esters, in which the hydrocarbyl moiety has, for example, from 4 to 22 carbon atoms. Suitable hydrocarbyl moieties include alkyl moieties which have, for example, from 4 to 22 carbon atoms. In at least some examples, the hydrocarbyl moiety comprises one or more hetero atoms for example nitrogen and/or oxygen.

In at least some examples, the derivative of the glyceride is an ether or an ester of the hydroxyl moiety of the hydroxy polycarboxylic acid. In at least some examples, if more than one hydroxy moiety is present in the mono-, di-, or tri-glyceride of at least one hydroxy polycarboxylic acid, each hydroxyl moiety is, for example, independently derivatisable as an ether or an ester. Suitable ethers include hydrocarbyl ethers. In at least some examples, the hydrocarbyl moiety of each ether independently has from 1 to 22 carbon atoms, for example from 1 to 18 carbon atoms. In at least some examples, the hydrocarbyl moiety of each ether is independently an alkyl moiety. Suitable alkyl moieties of each ether independently include alkyl moieties containing from 1 to 22 carbon atoms, for example from 1 to 18 carbon atoms. In at least some examples, the hydrocarbyl moiety of each ether independently comprises one or more hetero atoms, for example nitrogen and/or oxygen. In at least some examples, each ester is independently a hydrocarbyl ester. In at least some examples, the hydrocarbyl moiety of each ester has from 4 to 22 carbon atoms. Suitable hydrocarbyl moieties of each ester independently include alkyl moieties. In at least some examples, the alkyl moiety of each ester independently has from 4 to 22 carbon atoms. In at least some examples, the hydrocarbyl moiety of each ester independently comprises one or more hetero atoms, for example nitrogen and/or oxygen.

If the saturated, mono-unsaturated or polyunsaturated, branched or linear carboxylic acid containing 4 to 22 carbon atoms is a polycarboxylic acid, the derivative of the glyceride in at least some examples, is an ester of a carboxylic acid moiety of one or more of the at least one saturated, mono-unsaturated or poly-unsaturated, branched or linear, polycarboxylic acid containing from 4 to 22 carbon atoms, if present. In at least some examples, each ester independently is a hydrocarbyl ester. Suitable hydrocarbyl moieties of each ester independently include those containing from 4 to 22 carbon atoms. In at least some examples, the hydrocarbyl moiety is an alkyl moiety. Suitable alkyl moieties of each ester independently include those containing from 4 to 22 carbon atoms. In at least some examples, the hydrocarbyl moiety of each ester independently comprises one or more hetero atoms for example nitrogen and/or oxygen.

The oil-soluble mono-, di-, or tri-glycerides of at least one hydroxy polycarboxylic acid and derivatives thereof may be made by methods known in the art. Suitable methods for the preparation of the di- and tri-glycerides include the partial hydrolysis of a fat to produce a mono-glyceride followed by esterification with a hydroxy polycarboxylic acid. Suitable methods for the preparation of the mono-glycerides include esterification of glycerol with a hydroxy polycarboxylic acid. In at least some examples, the hydrocarbyl ether derivatives are made from corresponding hydrocarbyl halides.

The oil-soluble mono-, di-, or tri-glycerides of at least one hydroxy polycarboxylic acid and derivatives thereof do not contain zinc or molybdenum, that is, they are molybdenum-free and zinc-free. They also are sulphur-free and phosphorus-free.

GRINSTED CITREM SP70 (Trade Mark) has low volatility and has low toxicity.

Long Chain Fatty Acid Esters of Hydroxy Carboxylic Acids

Where the ashless, organic ester, anti-wear additive and/or friction modifier associated with lead corrosion is at least one long chain fatty acid ester of a hydroxy carboxylic acid in which the long chain fatty acid has at least 4 carbon atoms and the ester is an oil-soluble ester of a mono- or poly-hydroxy carboxylic acid containing 1 to 4 groups, as defined herein, in at least some examples, the oil-soluble ester has at least one long chain fatty acid ester moiety in an alpha position with respect to a carboxylic acid group or lower hydrocarbyl ester thereof.

In at least some examples, the oil-soluble ester defined according to the present invention contains from 16 to 80 carbon atoms. The number of carbon atoms in the ester may affect its solubility in oil of lubricating viscosity.

By oil-soluble is meant that the ester is soluble in an oil of lubricating viscosity, for example in a pour point depressant and friction modifying and/or antiwear improving amount, for example in an amount by weight of at least 200 ppm in an oil of lubricating viscosity. In at least some examples, the solubility is determined at ambient temperature, for example at 20° C. In at least some examples, the solubility is determined at atmospheric pressure.

Suitable mono-hydroxy carboxylic acids include:

- glycolic acid (also sometimes called 2-hydroxyethanoic acid; or hydroxyacetic acid);
- citric acid (also sometimes called 3-carboxy-3-hydroxy pentanedioic acid; 2-hydroxypropane-1,2,3-tricarboxylic acid; or 3-hydroxypentanedioic acid-3-carboxylic acid);
- lactic acid (also sometimes called 2-hydroxypropanoic acid);

malic acid (also sometimes called hydroxybutanedioic acid);

monohydroxy trimesic acid; and hydrogenated monohydroxy trimesic acid (also sometimes called 1,3,5 tricarboxy, 2-hydroxy cyclohexane).

In at least some examples, the mono-hydroxy carboxylic acid is citric acid.

Suitable poly-hydroxy carboxylic acids include:

tartaric acid (also sometimes called 2,3-dihydroxybutanedioic acid; or 2,3-dihydroxysuccinic acid).

In at least some examples, the poly-hydroxy carboxylic acid is tartaric acid.

The long chain fatty acid of the ester contains at least 4 carbon atoms. Examples of long chain fatty acids include saturated, mono-unsaturated or poly-unsaturated long chain fatty acids. Examples of long chain fatty acids that are saturated carboxylic acids include, for example, caproic acid, caprylic acid, capric acid, lauric acid, myristic acid, palmitic acid, stearic acid and arachidic acid. Examples of long chain fatty acids that are mono-unsaturated or polyunsaturated acids include, for example, oleic acid, linoleic acid, linolenic acid, myristoleic acid, palmitoleic acid, sapienic acid, erucic acid and brassidic acid. The long chain fatty acid may be branched or linear. Examples of long chain fatty acids include monocarboxylic acids and polycarboxylic acids. In at least some examples, the long chain fatty acid contains 4 to 22 carbon atoms, for example 5 to 22 carbon atoms, or 8 to 22 carbon atoms, or 8 to 18 carbon atoms or 14 to 22 carbon atoms, for example 8, 14, 16 or 18 carbon atoms, for example 8, 14 or 18 carbons atoms, or for example 14 carbon atoms. Suitable saturated $C_8$ monocarboxylic acids include octanoic acid. Suitable saturated $C_{14}$ monocarboxylic acids include myristic acid. Suitable saturated $C_{16}$ monocarboxylic acids include palmitic acid. Suitable saturated $C_{18}$ monocarboxylic acids include stearic acid. Suitable unsaturated $C_{18}$ monocarboxylic acids include oleic acid and linoleic acid.

In at least some examples, each carboxylic acid group of the mono- or poly-hydroxyl carboxylic acid is independently derivatisable or derivatized as a lower hydrocarbyl ester. The lower hydrocarbyl esters have hydrocarbyl moieties which independently include for example those containing 1 to 6 carbon atoms. In at least some examples, the lower hydrocarbyl moieties are independently straight chain or branched chain alkyl moieties. Suitable lower hydrocarbyl moieties of the lower hydrocarbyl esters include those for example that are independently $C_1$ to $C_6$ alkyl moieties, for example $C_1$ to $C_3$ alkyl moieties, for example, ethyl moieties.

In at least some examples, the ester is triethyl citrate oleate (sometimes also called oleyl triethyl citrate). In at least some examples, the ester is triethyl citrate butyrate, triethyl citrate octanoate or triethyl citrate myristate, for example triethyl citrate myristate.

In at least some examples, the ester is diethyl tartrate dioleate (sometimes also called diethyl dioleate tartrate or diethyl dioleyl tartrate). In at least some examples, the ester is diethyl tartrate dibutyrate.

The long chain fatty acid esters as defined in accordance with the present invention do not contain zinc or molybdenum, that is, they are molybdenum-free and zinc-free. They also are sulphur-free and phosphorus-free. Generally, the esters as herein defined will have low volatility.

Methods for making the long chain fatty acid esters as defined in accordance with the present invention are known in the art, for example by reaction of the corresponding long chain fatty acid with the corresponding mono- or poly-hydroxy carboxylic acid or its corresponding lower hydrocarbyl esters. Another suitable method involves reaction of an acyl halide of the corresponding long chain fatty acid with the corresponding mono- or poly-hydroxy carboxylic acid or its corresponding lower hydrocarbyl esters. For example, triethyl citrate oleate may be made by reaction of triethyl citrate with oleyl chloride, for example in the presence of sodium hydride and tetrahydrofuran solvent. The esters may be made by the Yamaguchi reaction.

The esters may also be made by using enzymes as biological esterification catalysts.

In at least some examples, the at least one fatty acid ester of a polyol, at least one oil-soluble glyceride of at least one hydroxy polycarboxylic acid, or a derivative thereof, and the at least one long chain fatty acid ester of a hydroxy carboxylic acid, as defined herein, are used as pour point depressant additives in non-aqueous lubricant compositions either alone or in any suitable combination.

Lubricant Compositions

In at least some examples, the metallic or non-metallic detergents which are hydrocarbyl-substituted salicylic acids or derivatives thereof are used as inhibitors of lead corrosion associated with ashless, organic ester, anti-wear additives and/or friction modifiers in any suitable lubricant compositions. Similarly, in at least some examples, the metallic or non-metallic detergents which are hydrocarbyl-substituted salicylic acids or derivatives thereof are used to improve the anti-corrosion properties, for example inhibiting lead corrosion associated with ashless, organic ester, anti-wear additives and/or friction modifiers, of any conventional lubricant compositions. Further details of suitable lubricant compositions are set out herein.

In at least some examples, the lubricant composition comprises a major amount of oil of lubricating viscosity and a minor amount of at least one metallic or non-metallic detergent which is a hydrocarbyl-substituted salicylic acid or derivatives thereof as an inhibitor of lead corrosion. Major amount means greater than 50% and minor amount means less than 50% by weight.

In at least some examples, the lubricant composition and the oil of lubricating viscosity comprise base oil. Base oil comprises at least one base stock. In at least some examples, the lubricant composition comprises one or more additives other than the metallic or non-metallic detergents which are hydrocarbyl-substituted salicylic acids or derivatives thereof. In at least some examples, the lubricant composition is essentially free of any additional detergents. In at least some examples, the lubricant composition and/or the oil of lubricating viscosity comprises base oil in an amount of from greater than 50% to about 99.5% by weight, for example from about 85% to about 95% by weight.

The base stocks may be defined as Group I, II, III, IV and V base stocks according to API standard 1509, "ENGINE OIL LICENSING AND CERTIFICATION SYSTEM", April 2007 version $16^{th}$ edition Appendix E, as set out in Table 1.

Group I, Group II and Group III base stocks may be derived from mineral oils. Group I base stocks are typically manufactured by known processes comprising solvent extraction and solvent dewaxing, or solvent extraction and catalytic dewaxing. Group II and Group III base stocks are typically manufactured by known processes comprising catalytic hydrogenation and/or catalytic hydrocracking, and catalytic hydroisomerisation. A suitable Group I base stock is AP/E core 150, for example, available from ExxonMobil. Suitable Group II basestocks include EHC 50 and EHC 110, for example, available from ExxonMobil. Suitable group III base stocks include Yubase 4 and Yubase 6 available, for example, from SK Lubricants. Suitable Group V base stocks include ester base stocks, for example Priolube 3970, available from Croda International plc. Suitable Group IV base stocks include hydrogenated oligomers of alpha olefins. In at least some examples, the oligomers are made by free radical processes, Zeigler catalysis or by cationic Friedel-Crafts catalysis. Polyalpha olefin base stocks may be derived from C8, C10, C12, C14 olefins and mixtures of one or more thereof.

TABLE 1

| Group | Saturated hydrocarbon content (% by weight) ASTM D2007 | | Sulphur content (% by weight) ASTM D2622 or D4294 or D4927 or D3120 | | Viscosity Index ASTM D2270 |
|---|---|---|---|---|---|
| I | <90 | and/or | >0.03 | and | ≥80 and <120 |
| II | ≥90 | and | ≤0.03 | and | ≥80 and <120 |
| III | ≥90 | and | ≤0.03 | and | ≥120 |
| IV | polyalpha olefins | | | | |
| V | all base stocks not in Groups I, II, III or IV | | | | |

In at least some examples, the lubricant composition and the oil of lubricating viscosity comprise one or more base oil and/or base stock which is/are natural oil, mineral oil (sometimes called petroleum-derived oil or petroleum-derived mineral oil), non-mineral oil and mixtures thereof. Natural oils include animal oils, fish oils, and vegetable oils. Mineral oils include paraffinic oils, naphthenic oils and paraffinic-naphthenic oils. Mineral oils may also include oils derived from coal or shale.

Suitable base oils and base stocks include those derived from processes such as chemical combination of simpler or smaller molecules into larger or more complex molecules (for example polymerisation, oligomerisation, condensation, alkylation, acylation).

Suitable base stocks and base oils include those derived from gas-to-liquids materials, coal-to-liquids materials, biomass-to-liquids materials and combinations thereof.

Suitable gas-to-liquids (sometimes also referred to as GTL) materials include those obtained by one or more process steps of synthesis, combination, transformation, rearrangement, degradation and combinations of two or more thereof applied to gaseous carbon-containing compounds. Suitable GTL derived base stocks and base oils include those obtained from the Fischer-Tropsch synthesis process in which synthesis gas comprising a mixture of hydrogen and carbon monoxide is catalytically converted to hydrocarbons, usually waxy hydrocarbons that are generally converted to lower-boiling materials hydroisomerisation and/or dewaxing (see for example, WO 2008/124191).

Suitable biomass-to-liquids (sometimes also referred to as BTL) materials include those manufactured from compounds of plant origin, for example by hydrogenation of carboxylic acids or triglycerides to produce linear paraffins, followed by hydroisomerisation to produced branched paraffins (see for example, WO-2007-068799-A).

Suitable coal-to-liquids materials include those made by gasifying coal to make synthesis gas which is then converted to hydrocarbons.

In at least some examples, the base oil and/or oil of lubricating viscosity have a kinematic viscosity at 100° C. in the range of 2 to 100 cSt, for example in the range of 3 to 50 cSt or in the range 3.5 to 25 cSt.

In at least some examples, the lubricant composition is a multi-grade lubricating oil composition according to the API classification xW-y where x is 0, 5, 10, 15 or 20 and y is 20, 30, 40, 50 or 60, as defined by SAE J300 2004, for example 5W-20, 5W-30, or 0W-20. In at least some examples, the lubricant composition has a High Temperature High Shear rate (HTHS) viscosity at 150° C. of at least 2.6 cP, for example as measured according to ASTM D4683, CEC L-36-A-90 or ASTM D5481.

In at least some examples, the lubricant composition has an HTHS viscosity at 150° C. according to ASTM D4683 of from 1 to <2.6 cP, for example about 1.8 cP.

Methods for preparing the lubricant composition include admixing an oil of lubricating viscosity with an effective lead corrosion inhibiting amount of at least one additive which is a metallic or non-metallic detergent which is a hydrocarbyl-substituted salicylic acid or derivative thereof together with, optionally, at least one other lubricant additive.

Uses and methods of improving the anti-corrosion properties of an oil of lubricating viscosity according to the present invention, include admixing an oil of lubricating viscosity with an effective lead corrosion inhibiting amount of at least one additive which is a metallic or non-metallic detergent which is a hydrocarbyl-substituted salicylic acid or derivative thereof.

In at least some examples, the oil of lubricating viscosity is admixed with at least one additive in one or more steps by methods known in the art. In at least some examples, the additives are admixed as one or more additive concentrates or part additive package concentrates, optionally comprising solvent or diluent. In at least some examples, the oil of lubricating viscosity is prepared by admixing in one or more steps by methods known in the art, one or more base oils and/or base stocks, optionally with one or more additives and/or part additive package concentrates. In at least some examples, the additives, additive concentrates and/or part additive package concentrates are admixed with oil of lubricating viscosity or components thereof in one or more steps by methods known in the art.

Anti-Wear Additives

In at least some examples, the lubricant composition comprises an ashless, organic ester, anti-wear additive and/or friction modifier, as discussed herein.

In at least some examples, the lubricant composition additionally or alternatively further comprises at least one anti-wear additive other than an ashless, organic ester, anti-wear additive and/or friction modifier. Such other anti-wear additives include ash-producing additives and ashless additives. Examples of such other anti-wear additives include non-phosphorus containing additives, for example sulphurised olefins. Examples of such other anti-wear additives also include phosphorus-containing anti-wear additives. Examples of suitable ashless phosphorus-containing anti-wear additives include trilauryl phosphite and triphenylphosphorothionate and those disclosed in paragraph [0036] of US 2005/0198894. Examples of suitable ash-forming, phosphorus-containing anti-wear additives include dihydrocarbyl dithiophosphate metal salts. Examples of suitable metals of the dihydrocarbyl dithiophosphate metal salts include alkali and alkaline earth metals, aluminium, lead, tin, molybdenum, manganese, nickel, copper and zinc. Suitable dihydrocarbyl dithiophosphate metal salts include zinc dihydrocarbyl dithiophosphates (ZDDP). Suitable ZDDP's include those comprising hydrocarbyl groups independently containing 1 to 18 carbon atoms, for example 2 to 13 carbon atoms or 3 to 18 carbon atoms, or for example 2 to 12 carbon atoms or 3 to 13 carbon atoms, for example 3 to 8 carbon atoms. Examples of suitable hydrocarbyl groups include alkyl, cycloalkyl and alkaryl groups, examples of which include those comprising ether or ester linkages and also those that comprise substituent groups, for example halogen or nitro groups. Suitable hydrocarbyl groups include alkyl groups including, for example, linear and/or branched alkyl groups including, for example, those containing from 3 to 8 carbon atoms. Suitable ZDDP's include those comprising hydrocarbyl groups which are a mixture of secondary alkyl groups and primary alkyl groups, for example 90 mol. % secondary alkyl groups and 10 mol. % primary alkyl groups.

The ashless, organic ester, anti-wear additive and/or friction modifier, where present, may reduce the amount of phosphorus- and/or zinc-containing anti-wear additive which might be required to achieve a desired amount of anti-wear properties for the lubricant composition.

In at least some examples, phosphorus-containing anti-wear additives are present in the lubricating oil composition at a concentration of 10 to 6000 ppm by weight of phosphorus, for example 10 to 1000 ppm by weight of phosphorus, or 200 to 1400 ppm by weight of phosphorus, or 200 to 800 ppm by weight of phosphorus or 200 to 600 ppm by weight of phosphorus.

It has been found that the presence in the lubricant composition of at least one ashless, organic ester, anti-wear additive and/or friction modifier may assist in the performance of anti-wear additives, such as, for example, zinc dihydrocarbyl dithiophosphate additives. This may reduce the amount of metals, for example zinc, present in the lubricant composition.

This may also reduce the amount of phosphorus-containing anti-wear additives in the lubricant composition, which in turn may reduce the amount of phosphorus in the exhaust emissions when the lubricant is used to lubricate an internal combustion engine. The reduction in the amount of phosphorus in the exhaust emissions may have benefits for any exhaust after treatment system.

This may also reduce the amount of sulphur-containing anti-wear additives in the lubricant composition, which in turn may reduce the amount of sulphur in exhaust emissions when the lubricant is used to lubricate an internal combustion engine. The reduction in the amount of sulphur in the exhaust emissions may have benefits for any exhaust after treatment system.

The use of a metallic or non-metallic detergent which is a hydrocarbyl-substituted salicylic acid or a derivative thereof in a non-aqueous lubricant composition in accordance with the present invention helps to reduce, or even eliminate, lead corrosion associated with the presence of ashless, organic ester, anti-wear additives and/or friction modifiers.

Other Friction Modifiers

In at least some examples, the lubricant composition additionally or alternatively comprises at least one friction modifier other than an additive which is an ashless, organic ester, anti-wear additive and/or friction modifier. Such other friction modifiers may be ash-producing additives or ashless additives. Examples of such other friction modifiers include fatty acid derivatives including, for example, fatty acid esters, amides, amines, and ethoxylated amines. Examples of such other friction modifiers also include molybdenum compounds, for example organo molybdenum compounds, molybdenum dialkyldithiocarbamates, molybdenum dialkylthiophosphates, molybdenum disulphide, tri-molybdenum cluster dialkyldithiocarbamates, non-sulphur molybdenum compounds and the like. Suitable molybdenum-containing compounds are described, for example, in EP-1533362-A1, for example, in paragraphs [0101] to [0117].

Examples of friction modifiers other than an additive which is an ashless, organic ester, anti-wear additive and/or friction modifier also include a combination of an alkoxylated hydrocarbyl amine and a polyol partial ester of a saturated or unsaturated fatty acid or a mixture of such esters, for example as described in WO 93/21288.

In at least some examples, an ashless, organic ester, anti-wear additive and/or friction modifier is used as an alternative to other friction modifiers and/or to reduce the amount of such other friction modifiers that might be required to achieve a desired friction property for the lubricant composition. This may reduce the amount of metals, for example molybdenum, present in the lubricant composition.

In at least some examples, friction modifiers other than an additive which is an ashless, organic ester, anti-wear additive and/or friction modifier, which are fatty acid derivative friction modifiers are present in the lubricating oil composition at a concentration of 0.01 to 5% by weight actives, for example in the range of 0.01 to 1.5% by weight actives.

In at least some examples, the molybdenum containing friction modifiers may be present in the lubricating oil composition at a concentration of 10 to 1000 ppm by weight molybdenum, for example in the range of 400 to 600 ppm by weight.

Other Additives.

In at least some examples, the lubricant composition also comprises other additives. Examples of such other additives include dispersants (metallic and non-metallic), dispersant viscosity modifiers, additional detergents (metallic and non-metallic), viscosity index improvers, viscosity modifiers, pour point depressants, rust inhibitors, corrosion inhibitors, antioxidants (sometimes also called oxidation inhibitors), anti-foams (sometimes also called anti-foaming agents), seal swell agents (sometimes also called seal compatibility agents), extreme pressure additives (metallic, non-metallic, phosphorus containing, non-phosphorus containing, sulphur containing and non-sulphur containing), surfactants, demulsifiers, anti-seizure agents, wax modifiers, lubricity agents, anti-staining agents, chromophoric agents and metal deactivators.

Dispersants

Dispersants (also called dispersant additives) help hold solid and liquid contaminants, for example resulting from oxidation of the lubricant composition during use, in suspension and thus reduce sludge flocculation, precipitation and/or deposition, for example on lubricated surfaces. They generally comprise long-chain hydrocarbons, to promote oil-solubility, and a polar head capable of associating with material to be dispersed. Examples of suitable dispersants include oil soluble polymeric hydrocarbyl backbones each containing one or more functional groups which are capable of associating with particles to be dispersed. Suitable functional groups include amine, alcohol, amine-alcohol, amide and ester groups. In at least some examples, the functional groups are attached to the hydrocarbyl backbone through bridging groups. In at least some examples, more than one dispersant is present in the lubricant composition.

Examples of suitable ashless dispersants include oil soluble salts, esters, amino-esters, amides, imides and oxazolines of long chain hydrocarbon-substituted mono- and polycarboxylic acids or anhydrides thereof; thiocarboxylate derivatives of long chain hydrocarbons; long chain aliphatic hydrocarbons containing polyamine moieties attached directly thereto; Mannich condensation products formed by condensing a long chain substituted phenol with formaldehyde and polyalkylene polyamine; Koch reaction products and the like. Examples of suitable dispersants include derivatives of long chain hydrocarbyl-substituted carboxylic acids, for example in which the hydrocarbyl group has a number average molecular weight of up to 20000, for example 300 to 20000, 500 to 10000, 700 to 5000 or less than 15000. Examples of suitable dispersants include hydrocarbyl-substituted succinic acid compounds, for example succinimide, succinate esters or succinate ester amides and in particular, polyisobutenyl succinimide dispersants. Suitable dispersants include those that are borated or non-borated. A suitable non-borated dispersant is ADX 222.

Dispersant Viscosity Modifiers

Additionally or alternatively, in at least some examples, dispersancy is provided by polymeric compounds capable of providing viscosity index improving properties and dispersancy. Such compounds are generally known as dispersant viscosity improver additives or multifunctional viscosity improvers. Methods of preparing such suitable dispersant viscosity modifiers include chemically attaching functional moieties (for example, amines, alcohols and amides) to polymers which tend to have number average molecular weights of at least 15000, for example in the range 20000 to 600000 (for example, as determined by gel permeation chromatography or light scattering methods). Examples of suitable dispersant viscosity modifiers and methods of making them are described in WO 99/21902, WO2003/099890 and WO2006/099250. In at least some examples, more than one dispersant viscosity modifier is present in the lubricant composition.

Additional Detergents

In at least some examples, the lubricant composition comprises no detergents other than metallic or non-metallic, hydrocarbyl-substituted salicylic acids or derivatives thereof. Alternatively, in at least some examples, the lubricant composition comprises one or more detergents in addition to a metallic or non-metallic, hydrocarbyl-substituted salicylic acid or a derivative thereof. Suitable additional detergents include ashless (that is non-metal containing) detergents and metal salts of organic acids. Examples of suitable metals include Group I and Group 2 metals, for example calcium, magnesium and combinations thereof, especially calcium. In at least some examples, more than one metal is present.

Examples of suitable organic acids include sulphonic acids, phenols (non-sulphurised or sulphurised and including, for example, phenols with more than one hydroxyl group, phenols with fused aromatic rings, phenols which have been modified, for example alkylene bridged phenols, and Mannich base-condensed phenols and saligenin-type phenols, produced, for example, by reaction of phenol and an aldehyde under basic conditions) and sulphurised derivatives thereof, and carboxylic acids including, for example, aromatic carboxylic acids. In at least some examples, more than one type of organic acid is present.

In at least some examples, additionally or alternatively, non-metallic detergents are present. Suitable non-metallic detergents are described, for example, in U.S. Pat. No. 7,622,431.

In at least some examples, more than one additional detergent is present in the lubricant composition.

Viscosity Index Improvers/Viscosity Modifiers

Viscosity index improvers (also called viscosity modifiers, viscosity improvers or VI improvers) impart high and low temperature operability to a lubricant composition and facilitate it remaining shear stable at elevated temperatures whilst also exhibiting acceptable viscosity and fluidity at low temperatures.

Examples of suitable viscosity modifiers include high molecular weight hydrocarbon polymers (for example polyisobutylene, copolymers of ethylene and propylene and higher alpha-olefins); polyesters (for example polymethacrylates); hydrogenated poly(styrene-co-butadiene or isoprene) polymers and modifications (for example star polymers); and esterified poly(styrene-co-maleic anhydride) polymers. Oil-soluble viscosity modifying polymers generally have number average molecular weights of at least 15,000 to 1,000,000, preferably 20,000 to 600,000 as determined by gel permeation chromatography or light scattering methods.

Viscosity modifiers may have additional functions as multifunction viscosity modifiers. In at least some examples more than one viscosity index improver is present.

Pour Point Depressants

Pour point depressants (also called lube oil improvers or lube oil flow improvers), lower the minimum temperature in which the lubricant will flow and can be poured. Examples of suitable pour point depressants include $C_8$ to $C_{18}$ dialkyl, fumarate/vinyl acetate copolymers, methacrylates, polyacrylates, polyarylamides, polymethacrylates, polyalkyl methacrylates, vinyl fumarates, styrene esters, condensation products of haloparaffin waxes and aromatic compounds, vinyl carboxylate polymers, terpolymers of dialkylfumarates, vinyl esters of fatty acids and allyl vinyl ethers, wax naphthalene and the like.

In at least some examples, more than one pour point depressant is present.

Rust Inhibitors

Rust inhibitors generally protect lubricated metal surfaces against chemical attack by water or other contaminants. Examples of suitable rust inhibitors include non-ionic polyoxyalkylene polyols and esters thereof, polyoxyalkylene phenols, polyoxyalkylene polyols, anionic alkyl sulphonic acids, zinc dithiophosphates, metal phenolates, basic metal sulphonates, fatty acids and amines.

In at least some examples, more than one rust inhibitor is present.

Additional Corrosion Inhibitors

In at least some examples, the lubricant composition comprises no corrosion inhibitors other than the metallic or non-metallic hydrocarbyl-substituted salicylic acids or derivatives thereof. Alternatively, in at least some examples, the lubricant composition comprises one or more corrosion inhibitors in addition to the metallic or non-metallic, hydrocarbyl-substituted salicylic acids or derivatives thereof. Examples of additional corrosion inhibitors include phosphosulphurised hydrocarbons and the products obtained by the reaction of phosphosulphurised hydrocarbon with an alkaline earth metal oxide or hydroxide, non-ionic polyoxyalkylene polyols and esters thereof, polyoxyalkylene phenols, thiadiazoles, triazoles and anionic alkyl sulphonic acids. Examples of suitable epoxidised ester corrosion inhibitors are described in US 2006/0090393.

In at least some examples, more than one additional corrosion inhibitor is present.

Antioxidants

Antioxidants (sometimes also called oxidation inhibitors) reduce the tendency of oils to deteriorate in use. Evidence of such deterioration might include, for example, the production of varnish-like deposits on metal surfaces, the formation of sludge and viscosity increase. ZDDP's exhibit some antioxidant properties.

Examples of suitable antioxidants other than ZDDP's include alkylated diphenylamines, N-alkylated phenylenediamines, phenyl-α-naphthylamine, alkylated phenyl-α-naphthylamines, dimethylquinolines, trimethyldihydroquinolines and oligomeric compositions derived therefrom, hindered phenolics (including ashless (metal-free) phenolic compounds and neutral and basic metal salts of certain phenolic compounds), aromatic amines (including alkylated and non-alkylated aromatic amines), sulphurised alkyl phenols and alkali and alkaline earth metal salts thereof, alkylated hydroquinones, hydroxylated thiodiphenyl ethers, alkylidenebisphenols, thiopropionates, metallic dithiocarbamates, 1,3,4-dimercaptothiadiazole and derivatives, oil soluble copper compounds (for example, copper dihydrocarbyl thio- or thio-phosphate, copper salts of a synthetic or natural carboxylic acid, for example a $C_8$ to $C_{18}$ fatty acid, an unsaturated acid or a branched carboxylic acid, for example basic, neutral or acidic $Cu^{I}$ and/or $Cu^{II}$ salts derived from alkenyl succinic acids or anhydrides), alkaline earth metal salts of alkylphenolthioesters, for example, containing $C_5$ to $C_{12}$ alkyl side chains, calcium nonylphenol sulphide, barium t-octylphenyl sulphide, dioctylphenylamine, phosphosulphised or sulphurised hydrocarbons, oil soluble phenates, oil soluble sulphurised phenates, calcium dodecylphenol sulphide, phosphosulphurised hydrocarbons, sulphurised hydrocarbons, phosphorus esters, low sulphur peroxide decomposers and the like.

In at least some examples, more than one antioxidant is present. In at least some examples, more than one type of antioxidant is present.

Antifoams

Anti-foams (sometimes also called anti-foaming agents) retard the formation of stable foams. Examples of suitable anti-foam agents include silicones, organic polymers, siloxanes (including poly siloxanes and (poly) dimethyl siloxanes, phenyl methyl siloxanes), acrylates and the like.

In at least some examples, more than one anti-foam is present.

Seal Swell Agents

Seal swell agents (sometimes also called seal compatibility agents or elastomer compatibility aids) help to swell elastomeric seals for example by causing a reaction in the fluid or a physical change in the elastomer. Examples of suitable seal swell agents include long chain organic acids, organic phosphates, aromatic esters, aromatic hydrocarbons, esters (for example butylbenzyl phthalate) and polybutenyl succinic anhydride.

In at least some examples, more than one seal swell agent is present.

Other Additives

In at least some examples, other additives are present in the lubricant composition and these include, for example, extreme pressure additives (including metallic, non-metallic, phosphorus containing, non-phosphorus containing, sulphur containing and non-sulphur containing, extreme pressure additives), surfactants, demulsifiers, anti-seizure agents, wax modifiers, lubricity agents, anti-staining agents, chromophoric agents and metal deactivators.

Some additives may exhibit more than one function.

The amount of demulsifier, if present, might be higher than in conventional lubricants to off-set any emulsifying effect of the ashless, organic ester, anti-wear additives and/or friction modifiers, where present.

The representative suitable and more suitable independent amounts of additives (if present) in the lubricant composition are given in Table 2. The concentrations expressed in Table 2 are by weight of active additive compounds, that is, independent of any solvent or diluent.

In at least some examples, more than one of each type of additive is present. Within each type of additive, in at least some examples, more than one class of that type of additive is present. In at least some examples, more than one additive of each class of additive is present. In at least some examples, additives are supplied by manufacturers and suppliers in solvent or diluents.

TABLE 2

| | Lubricant Composition | |
|---|---|---|
| ADDITIVE TYPE | Suitable amount (actives), if present (by weight) | More suitable amount (actives), if present (by weight) |
| Hydrocarbyl-substituted salicylic acid or derivative detergents | 0.5 to 15% | 1 to 10% |
| Ashless, organic ester, anti-wear additives and/or friction modifiers | 0.02 to 5% | 0.1 to 2.5% |
| Phosphorus-containing anti-wear additives | corresponding to 10 to 6000 ppm P | corresponding to 10 to 1000 ppm P |
| Molybdenum-containing anti-wear additives | corresponding to 10 to 1000 ppm Mo | corresponding to 40 to 600 ppm Mo |
| Boron-containing anti-wear additives | corresponding to 10 to 250 ppm B | corresponding to 50 to 100 ppm B |
| Friction modifiers other than ashless, organic ester, anti-wear additives and/or friction modifiers | 0.01 to 5% | 0.01 to 1.5% |
| Molybdenum-containing friction modifiers | corresponding to 10 to 1000 ppm Mo | corresponding to 400 to 600 ppm Mo |
| Dispersants | 0.1 to 20% | 0.1 to 8% |
| Detergents other than hydrocarbyl-substituted salicylic acid or derivative detergents | 0.01 to 6% | 0.01 to 4% |
| Viscosity index improvers | 0.01 to 20% | 0.01 to 15% |
| Corrosion and/or rust inhibitors other than hydrocarbyl-substituted salicylic acid or derivative detergents | 0.01 to 5% | 0.01 to 1.5% |
| Anti-oxidants | 0.1 to 10% | 0.5 to 5% |
| Antifoams containing silicon | corresponding to 1 to 20 ppm Si | corresponding to 1 to 10 ppm Si |

Lubricant Applications

In at least some examples, the metallic or non-metallic detergents which are hydrocarbyl-substituted salicylic acids or derivatives thereof are used as inhibitors of lead corrosion associated with ashless, organic ester, anti-wear additives and/or friction modifiers in any suitable non-aqueous lubricant compositions.

In at least some examples, the metallic or non-metallic detergents which are hydrocarbyl-substituted salicylic acids or derivatives thereof are used as inhibitors of lead corrosion associated with ashless, organic ester, anti-wear additives and/or friction modifiers in a lubricant composition which is a functional fluid, for example a metalworking fluid. In at least some examples, this metalworking fluid is used to lubricate metals during machining, rolling and the like.

In at least some examples, the metallic or non-metallic detergents which are hydrocarbyl-substituted salicylic acids or derivatives thereof are used as inhibitors of lead corrosion associated with ashless, organic ester, anti-wear additives and/or friction modifiers in a lubricant composition which is a power transmission fluid, for example an automatic transmission fluid, a fluid in a clutch (for example a dual clutch), a gear lubricant, or in other automotive applications and the like. In at least some examples, the lubricant composition is used in aviation lubricant applications.

In at least some examples, the metallic or non-metallic detergents which are hydrocarbyl-substituted salicylic acids or derivatives thereof are used as inhibitors of lead corrosion associated with ashless, organic ester, anti-wear additives and/or friction modifiers in a non-aqueous lubricant composition used to lubricate a solid surface, including, for example, metallic surfaces and non-metallic surfaces. Suitable metallic surfaces include surfaces of ferrous based materials, for example cast iron and steels; surfaces of aluminium-based solids, for example aluminium-silicon alloys; surfaces of metal matrix compositions; surfaces of copper and copper alloys; surfaces of lead and lead alloys; surfaces of zinc and zinc alloys; and surfaces of chromium-plated materials. Suitable non-metallic surfaces include surfaces of ceramic materials; surfaces of polymer materials; surfaces of carbon-based materials; and surfaces of glass. Other surfaces which may be lubricated include surfaces of coated materials, for example surfaces of hybrid materials, for example metallic materials coated with non-metallic materials and non-metallic materials coated with metallic materials; surfaces of diamond-like carbon coated materials and SUMEBore™ materials, for example as described in Sulzer technical review 4/2009 pages 11-13.

In at least some examples, the metallic or non-metallic detergents which are hydrocarbyl-substituted salicylic acids or derivatives thereof are used in a non-aqueous lubricant composition to lubricate a surface at any typical temperature which might be encountered in a lubricating environment, for example at a temperature such as may be encountered in an internal combustion engine, for example a temperature in the range of ambient to 250° C., e.g. 90 to 120° C. Typical ambient temperature is 20° C., but in at least some examples is less than 20° C., for example 0° C. or lower.

Internal Combustion Engine Lubrication

In at least some examples, the metallic or non-metallic detergents which are hydrocarbyl-substituted salicylic acids or derivatives thereof are used as inhibitors of lead corrosion associated with ashless, organic ester, anti-wear additives and/or friction modifiers in a lubricant composition which is used to lubricate an internal combustion engine, for example as a crankcase lubricant. Examples of suitable engines include spark-ignition, internal combustion engines, and compression-ignition, internal combustion engines. In at least some examples, the internal combustion engine is a spark-ignition internal combustion engine used in automotive or aviation applications. Suitable internal combustion engines include two-stroke compression-ignition engines and, in at least some examples, the metallic or non-metallic detergents which are hydrocarbyl-substituted salicylic acids or derivatives thereof are used as inhibitors of lead corrosion associated with ashless, organic ester, anti-wear additives and/or friction modifiers in a system oil lubricant composition and/or a cylinder oil lubricant composition used to lubricate the engine. In at least some examples, the two-stroke compression-ignition engine is used in marine applications.

The invention will now be described by way of example only with reference to the following experiments. Experiments not according to the present invention are labeled Experiments A and B whilst the example according to the present invention is labeled Example 1.

Preparation of Lubricant Compositions.

A lubricant composition (Lubricant A) was prepared to model a typical lubricant composition suitable for passenger cars with either compression-ignition or spark-ignition internal combustion engines. The lubricant composition was made by admixing additives as in a commercially available additive package containing dispersant, calcium sulphonate and calcium phenate detergents, antioxidant, antifoam and ZDDP with Group I and III base oils, a pour point depressant and a viscosity modifier.

A lubricant composition (Lubricant B) was prepared to model a lubricant composition suitable for passenger cars with either compression-ignition or spark-ignition internal combustion engines additionally comprising friction modifiers/anti-wear additives. The lubricant composition was generally prepared as Lubricant A, but with the addition of 0.1% by weight of oleamide and 0.5% by weight of Citrem SP 70 (Trade Mark) (a diglyceride of citric acid and oleic/linoleic acid).

A lubricant composition (Lubricant 1) according to the present invention was made by admixing additives as in a commercially available additive package containing dispersant, calcium salicylate detergent, antioxidant, antifoam and ZDDP with Group III base oil, a pour point depressant, a viscosity modifier, a dispersant viscosity modifier, 0.1% by weight of oleamide and 0.5% by weight of Citrem SP 70 (Trade Mark) (a diglyceride of citric acid and oleic/linoleic acid).

Lubricants A and B are not according to the present invention because the lubricant compositions do not contain a salicylate detergent. Lubricant 1 is according to the present invention.

1. Corrosion Testing of Lubricant Compositions.

Sequence VIII corrosion tests according to ASTM D6709-13 were undertaken for Lubricants A and B, as well as for Lubricant 1. The Sequence VIII test evaluates the performance of a lubricant intended for use in spark-ignition gasoline engines for resisting copper-, lead-, or tin-bearing corrosion. The test procedure is conducted using a carbureted, spark-ignition Cooperative Lubrication Research (CLR) Oil Test Engine (also referred to as the Sequence VIII test engine) run on unleaded fuel. The engine runs continuously for 40 test hours at a test speed of 3,150 rpm. Oil temperature is raised to 143° C. (290° F.) using an external oil heater. The pass/fail criteria for the test include a maximum bearing weight loss of 26.4 mg. There is a good correlation between Seq VIII results and lead corrosion resistance in HTCBT bench tests.

The results for the tests are shown in Table 3. Experiments A and B are not according to the present invention because the lubricant compositions do not contain a salicylate detergent. Example 1 is according to the present invention.

The results in Table 3 show that the salicylate detergent reduces the corrosive effects, particularly lead corrosion associated with the presence of an ashless, organic ester, anti-wear additive and/or friction modifier, in particular a diglyceride of citric acid and an unsaturated $C_{18}$ carboxylic acid (e.g. oleic and/or linoleic acid), for example Citrem SP70 (Trade Mark).

TABLE 3

| | Lubricant | Ashless, organic ester, anti-wear additive | Detergent system | Treat rate of anti-wear additive (wt. %) | Bearing Weight Loss (mg) |
|---|---|---|---|---|---|
| Expt. A | A | — | Calcium sulphonate/ Calcium Phenate | — | 20 |
| Expt. B | B | Citrem SP70 | Calcium sulphonate/ Calcium Phenate | 0.5% | 34.7 |
| Example 1 | 1 | Citrem SP70 | Calcium salicylate | 0.5% | 12 |

The invention claimed is:

1. A method of improving anti-corrosion properties of a non-aqueous lubricant composition, the method comprising admixing (a) the non-aqueous lubricant composition comprising an ashless, organic ester, anti-wear additive and/or friction modifier with (b) a metallic or non-metallic detergent which is a $C_{10}$-$C_{30}$ hydrocarbyl-substituted salicylic acid or a derivative thereof, the metallic or non-metallic detergent present in the non-aqueous lubricant composition in a concentration of between 2.5 and 8% by weight, to produce the non-aqueous lubricant composition comprising said metallic or non-metallic detergent in an amount sufficient to pass Sequence VIII corrosion test according to ASTM D6709-13, wherein the non-aqueous lubricant composition comprising the ashless, organic ester, anti-wear additives and/or friction modifier without said metallic or non-metallic detergent fails Sequence VIII corrosion test according to ASTM D6709-13, wherein the ashless, organic ester, anti-wear additive and/or friction modifier is provided in a liquid fuel composition used to operate the internal combustion engine, and a portion of said ashless, organic ester, anti-wear and/or friction modifier ingresses into the non-aqueous lubricant composition during operation of said engine.

2. The method of claim 1, wherein the non-aqueous lubricant composition is used to lubricate an internal combustion engine.

3. The method of claim 1, wherein the $C_{10}$-$C_{30}$ hydrocarbyl-substituted salicylic acid or a derivative thereof is a metallic $C_{10}$-$C_{30}$ hydrocarbyl substituted salicylic acid or a derivative thereof.

4. The method of claim 3, wherein the metal salt is selected from the group consisting of calcium, magnesium, sodium and combinations thereof.

5. The method of claim 1, wherein the metallic or non-metallic detergent is a sulphurised derivative of the $C_{10}$-$C_{30}$ hydrocarbyl-substituted salicylic acid.

6. The method of claim 1 wherein the ashless, organic ester, anti-wear additive and/or friction modifier is i) at least one fatty acid ester of a polyol, ii) at least one oil-soluble mono, di-, or tri-glyceride of at least one hydroxy polycarboxylic acid, or a derivative thereof;

iii) at least one long chain fatty acid ester of a hydroxy carboxylic acid in which the long chain fatty acid has at least 4 carbon atoms and the ester is an oil-soluble ester of a mono- or poly-hydroxy carboxylic acid containing 1 to 4 groups which are independently carboxylic acid groups or lower hydrocarbyl esters thereof and in which, when the hydroxy carboxylic acid is a mono-hydroxy carboxylic acid, the ester has a long chain fatty acid ester moiety of the hydroxy group of the hydroxy carboxylic acid and, when the hydroxy carboxylic acid is a poly-hydroxy carboxylic acid, the ester has independently long chain fatty acid ester moieties of one or two of the hydroxy groups of the poly-hydroxy carboxylic acid; or iv) a mixture thereof.

7. The method of claim 6, wherein the at least one fatty acid ester of a polyol is an ester of a fatty acid containing 12 to 24 carbon atoms.

8. The method of claim 6, wherein the hydroxy polycarboxylic acid has at least one hydroxy group which is in an alpha position with respect to a carboxylic moiety.

9. The method of claim 8, wherein the hydroxy polycarboxylic acid is citric acid.

10. The method of claim 6, wherein the glyceride is a glyceride of citric acid and oleic acid, a glyceride of citric acid and linoleic acid or a mixture thereof.

11. The method of claim 6, wherein the oil-soluble ester has at least one long chain fatty acid ester moiety in an alpha position with respect to a carboxylic acid group or lower hydrocarbyl ester thereof.

12. The method of claim 6, wherein the oil-soluble ester is triethyl citrate butyrate, triethyl citrate oleate, triethyl citrate octanoate, triethyl citrate myristate, diethyl tartrate dibutyrate or diethyl tartrate dioleate.

13. The method of claim 1, wherein the ashless, organic ester, anti-wear additives and/or friction modifier is present in the non-aqueous lubricant composition at a concentration of 0.1 wt % to 2.5 wt %.

14. The method of claim 1, wherein the non-aqueous lubricant composition comprising the metallic or non-metallic detergent has maximum bearing loss of 26.4 mg as measured by Sequence VIII corrosion test according to ASTM D6709-13.

15. The method of claim 1, wherein the metallic or non-metallic detergent is a $C_{16}$-$C_{18}$ hydrocarbyl-substituted salicylic acid or a derivative thereof.

16. The method of claim 6, wherein the at least one fatty acid ester of a polyol is glycerol mono-oleate, glycerol monostearate, glycerol monolaurate, glycerol dodecanoate or glycerol octadodecanoate.

17. The method of claim 1, wherein the method improves anti-corrosion of lead, wherein the lead corrosion is associated with ashless, organic ester, anti-wear additive and/or friction modifier.

* * * * *